United States Patent [19]

Maxwell, deceased

[11] Patent Number: 4,543,314

[45] Date of Patent: Sep. 24, 1985

[54] PROCESS FOR PREPARING ELECTROSTATOGRAPHIC PHOTOSENSITIVE DEVICE COMPRISING SODIUM ADDITIVES AND TRIGONAL SELENIUM PARTICLES

[75] Inventor: Kenneth H. Maxwell, deceased, late of Palmyra, N.Y., by Shelagh M. Maxwell, executor

[73] Assignee: Xerox Corporation, Stamford, Conn.

[21] Appl. No.: 557,498

[22] Filed: Dec. 1, 1983

[51] Int. Cl.[4] ..... G03G 5/087; G03G 5/00

[52] U.S. Cl. ..... 430/134; 427/76; 430/84; 430/95; 430/134; 430/135

[58] Field of Search ..... 430/127, 134, 135, 84, 430/95; 427/76

[56] References Cited

U.S. PATENT DOCUMENTS

| | | | |
|---|---|---|---|
| 660,013 | 10/1900 | Head et al. | 423/510 |
| 3,121,006 | 6/1957 | Middleton et al. | 96/1 |
| 3,589,928 | 8/1966 | Sawato et al. | 117/34 |
| 3,685,989 | 12/1970 | Galen | 96/1 |
| 3,911,091 | 10/1975 | Karam et al. | 430/84 |
| 3,953,207 | 4/1976 | Horgan | 96/1 |
| 3,961,953 | 6/1976 | Millonzi | 96/1.5 |
| 4,175,959 | 11/1979 | Karam et al. | 430/134 |
| 4,232,102 | 11/1980 | Horgan et al. | 430/58 |
| 4,233,383 | 11/1980 | Horgan | 430/58 |

*Primary Examiner*—John E. Kittle.
*Assistant Examiner*—Mukund J. Shah
*Attorney, Agent, or Firm*—Peter H. Konod; John E. Beck; Ronald Zibelli

[57] ABSTRACT

A process for the preparation of an electrostatographic photosensitive device comprising combining a sodium additive comprising sodium carbonate, sodium bicarbonate, sodium selenite, sodium hydroxide or mixtures thereof with trigonal selenium particles, an organic resin binder and a solvent for the binder to form a milling mixture, milling the milling mixture to form a uniform dispersion, applying the dispersion to a substrate in an even layer and drying the layer.

16 Claims, No Drawings

PROCESS FOR PREPARING ELECTROSTATOGRAPHIC PHOTOSENSITIVE DEVICE COMPRISING SODIUM ADDITIVES AND TRIGONAL SELENIUM PARTICLES

BACKGROUND OF THE INVENTION

This invention relates in general to xerography and more specifically to a novel process for preparing an electrostatographic photosensitive device.

Vitreous and amorphous selenium photoconductive materials have enjoyed wide use in reusable photoconductors in commercial xerography. However, the spectral response of these materials is limited largely to the blue-green portion of the visible spectrum, i.e. below 5200 Angstrom units.

Selenium also exists in a crystalline form known as trigonal or hexagonal selenium. Trigonal selenium is well known in the semiconductor art for use in the manufacture of selenium rectifiers.

In the past, trigonal selenium was not normally used in xerography as a photoconductive layer because of its relatively high electrical conductivity in the dark, although in some instances, trigonal selenium can be used in a binder configuration in which the trigonal selenium particles are dispersed in a matrix of another material such as an electrically active organic material or vitreous selenium.

It is also known that a thin layer of trigonal selenium overcoated with a relatively thick layer of electrically active organic material, forms a useful composite photosensitive member which exhibits improved spectral response and increased sensitivity over conventional vitreous selenium-type photoreceptors. This device and method are described, for example, in U.S. Pat. No. 3,961,953 to Millonzi et al.

It is also known that when using trigonal selenium, whether it be dispersed in a binder or used as a generation material in a composite photoconductor device, the trigonal selenium exhibits a high dark decay after the photoreceptor has been cycled in a xerographic process. This is referred to as fatigued dark decay. Also, after cycling the photoreceptor in a xerographic process, the photoreceptor will not accept as not charge as it did initially. Fatigued dark decay is the dark decay observed after a photoreceptor has completed at least one xerographic cycle, is erased and recharged.

A process for controlling dark decay by treatment of trigonal selenium is described in U.S. Pat. No. 4,232,102 to Horgan et al. The process provides treated trigonal selenium for photosensitive devices with improved cyclic charge acceptance and control and also improved dark decay both initially and after cycling an imaging member in a xerographic process. The treatment process involves, for example, swirling washed trigonal selenium in a 0.6 normal (N) solution of sodium hydroxide for one-half hour and then allowing the solids to settle out and remain in contact with the sodium hydroxide solution for 18 hours. The supernatent liquid is decanted and retained and the treated trigonal selenium is filtered with filter paper. The retained supernatant liquid is used to rinse the beaker and funnel. The trigonal selenium is then dried at 60° C. in a forced air oven for 18 hours. The total sodium selenite and sodium carbonate levels in the resulting mixture average approximately 1.0 percent by weight on an approximately equimolar basis based on the weight of the trigonal selenium.

Although satisfactory results may be achieved with the specific process described in U.S. Pat. No. 4,232,102, the 18 hours utilized for contacting the trigonal selenium with sodium hydroxide and the 18 hours employed for forced air drying are time consuming. Moreover, the sodium content of the final treated trigonal selenium cannot be accurately predicted and the sodium content of the final treated trigonal selenium can vary as much as 52% from the lowest weight percent sodium content to the highest weight percent sodium content Further, undesirable absorption of water occurs during storage prior to incorporation of the sodium doped selenium into a photosensitive device.

OBJECTS OF THE INVENTION

It is, therefore, an object of this invention to provide a novel process for preparing an electrostatographic photosensitive device which overcomes the above-noted disadvantages.

It is a further object of this invention to provide a more precise process to treat trigonal selenium so as to control dark decay.

It is a further object of this invention to provide a more energy and time efficient process utilizing fewer steps to treat trigonal selenium so as to control dark decay.

It is a further object of this invention to eliminate the absorption of water by sodium doped trigonal selenium prior to incorporation into a milling mixture for a photosensitive device.

SUMMARY OF THE INVENTION

The foregoing objects and others are accomplished in accordance with this invention by preparing an electrostatographic photosensitive device comprising combining a sodium additive comprising sodium carbonate, sodium bicarbonate, sodium selenite, sodium hydroxide or mixtures thereof with trigonal selenium particles, an organic resin binder and a solvent for the binder to form a milling mixture, milling the milling mixture to form a uniform dispersion and applying the dispersion to a substrate in an even layer and drying the layer. The sodium additive may be added to form the milling mixture as an anhydrous salt or in a concentrated aqueous solution. If the sodium additive is in the form of a concentrated aqueous solution, it should contribute to the milling mixture less than about 20 percent by weight water based on the total weight of the trigonal selenium. The milling mixture is milled until a uniform dispersion of trigonal selenium particles having an average particle size of between about 0.01 micrometer and about 5 micrometers is formed. The smaller particle size increases the light sensitivity of the binder layer and increases the surface area exposed to the sodium during milling.

It has been found that the presence of sodium is the principal factor that causes water absorption during storage and that the process of this invention eliminates such presence while providing stable and predictable electrical properties and significantly reducing the processing time. In addition, the relative quantity of water in the milling mixture may be reduced significantly and can even be omitted. Moreover, the process of this invention eliminates variations in sodium content of doped milling mixtures and prevents trigonal selenium from exhibiting unacceptable and undesirable values of dark decay either before charging or discharging the member or after the member has been cycled through a complete xerographic process, that is, charged and erased and then re-charged in the dark.

Typical applications of the doped milling mixtures of the invention include, as mentioned above, a single photoconductive layer having trigonal selenium in particulate form and a sodium dopant dispersed in an organic resin binder. This may be used as the photosensitive device itself. Another typical application of the product of the invention includes a photosensitive member which has at least two operative layers. The first layer comprises the above-mentioned single photoconductive layer. This layer is capable of photogenerating charge carriers and injecting these photogenerated charge carriers into a contiguous or adjacent charge carrier transport layer. A second layer is a charge carrier transport layer which may comprise a transparent organic polymer or a non-polymeric material which when dispersed in an organic polymer results in the organic polymer becoming active, i.e. capable of transporting charge carriers. The charge carrier transport material should be substantially non-absorbing to visible light or radiation in the region of intended use, but which is "active" in that it allows the injection of photogenerated charge carriers, e.g. holes, from the particular trigonal selenium layer and allows these charge carriers to be transported through the active layer to selectively discharge the surface charge on the free surface of the active layer.

The active materials need not be restricted to those which are transparent in the entire visible wavelength region. For example, when used with a transparent substrate, imagewise exposure may be accomplished through the substrate without the light passing through the layer of active material, i.e. charge transport layer. In this case, the active layer need not be non-absorbing in the wavelength region of use. Other applications where complete transparency is not required for the active material in the visible region include a selective recording of narrow band radiation such as emitted from lasers, spectral pattern recognition and possible functional color xerography, such as color coded form duplication.

The doped milling mixtures of the instant invention may be used in an imaging member having a first layer of electrically active charge transport material contained on a supporting surface, a photoconductive layer of the instant invention overlying the active layer and a second layer of electrically active charge transport material overlying the photoconductive layer. This member is more fully described in U.S. Pat. No. 3,953,207, the entire contents of which is hereby incorporated herein by reference.

The imaging member containing the doped, dried milling mixture may comprise a supporting substrate layer having the binder layer thereon. The substrate preferably comprises any suitable conductive material. Typical conductive materials comprise aluminum, steel, nickel, brass or the like. The substrate may be rigid or flexible and of any conventional thickness. Typical substances include flexible belts or sleeves, sheets, webs, plates, cylinders and drums. The substrate or support may also comprise a composite structure such as a thin conductive coating on a paper base; a plastic web coated with a thin conductive layer such as aluminum, nickel or copper iodine; or glass coated with a thin conductive coating of chromium or tin oxide.

In addition, if desired, an electrically insulating substrate may be used. In this case, the charge may be placed upon the insulating member by double corona charging techniques well known and disclosed in the prior art. Other modifications using an insulating substrate or no substrate at all including placing the imaging member on a conductive backing member or plate during charging of the surface while in contact with the backing member. Subsequent to imaging, the imaging member may then be stripped from the conductive backing.

The binder layer contains the trigonal selenium particles treated with sodium carbonate, sodium bicarbonate, sodium selenite, sodium hydroxide or mixtures thereof in an amount of from about 2 parts per million to about 2.5 percent by weight sodium based on the weight of the trigonal selenium. When less than about 2 parts per million sodium based on the weight of the trigonal selenium is added to the milling mixture, the binder layer begins to behave like an undoped binder layer. Humidity sensitivity, pitting of aluminum conductive layers and reduced adhesion of the binder layer approaches a significant level when the sodium content exceeds about 2.5 percent by weight sodium based on the weight of the trigonal selenium. The trigonal selenium particles may be randomly dispersed without orientation in the binder layer.

Binder material for the binder layer may comprise any suitable electrically insulating resin such as those disclosed in Middleton et al, U.S. Pat. No. 3,121,006, the entire contents of which are incorporated herein by reference. The binder material may also comprise Saran, available from Dow Chemical Company, which is a copolymer of a polyvinylchloride and polyvinylidenechloride; polystyrene polymers; and polyvinylbutyral polymers. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. The thickness of the binder layer is not critical. Layer thicknesses from about 0.05 micrometer to about 40.0 micrometers have been found to be satisfactory.

The preferred materials are sodium carbonate, sodium bicarbonate, sodium selenite or mixtures thereof. Satisfactory results may be achieved with an amount of from about 2 parts per million to about 2.5 percent by weight sodium based on the weight of the trigonal selenium. The most preferred total amount of these materials is such that the sodium content is about 5 parts per million to about 1 percent by weight based on the weight of the trigonal selenium in the milling mixture. This is the most preferred amount when using electrically active binders such as poly-N-vinylcarbazole. However, this amount may vary if binders, such as electrically inactive binders, are used. Preferably there may be an adhesive charge blocking layer between the substrate and the charge generation layer.

The preferred size of the particulate trigonal selenium particles is from about 0.01 micrometer to about 5 micrometers in diameter. The most preferred size of the trigonal selenium particles is from about 0.03 micrometer to about 0.5 micrometer in diameter.

In still another embodiment, an imaging member may comprise a supporting substrate having a binder layer thereon and a charge transport layer positioned over the binder layer. The substrate may be of the same material as described above. The binder layer may also be of the same construction as described above.

The active charge transport layer may comprise any suitable transparent organic polymer or non-polymeric materials capable of supporting the injection of photogenerated holes and electrons from the trigonal selenium binder layer and allowing the transport of these holes or electrons through the organic layer to selectively discharge the surface charge.

Polymers having this characteristic, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active layer not only serves to transport holes or electrons, but also protects the photoconductive layer from abrasion or chemical attack and therefor extends the operating life of the photoreceptor imaging member.

The reason for the requirement that the active layer should be transparent is that most of the incident radiation is utilized by the underlying charge carrier generator layer for efficient photogeneration.

The charge transport layer will exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer.

When used with a transparent substrate, imagewise exposure may be accomplished through the substrate with all light passing through the substrate. In this case, the active material need not be absorbing in the wavelength region of use. The active layer in conjunction with the generation layer in the instant invention is a material which is an insulator to the extent that an electrostatic charge placed on the active transport layer is not conductive in the absence of illumination, i.e. a rate sufficient to prevent the formation and retention of an electrostatic latent image thereon.

In general, the thickness of the active layer should be from about 5 to about 100 micrometers, but thicknesses outside this range can also be used. The ratio of the thickness of the active layer to the charge generation layer should be maintained from about 2:1 to 200:1 and in some instances as great as 400:1. However, ratios outside this range can also be used.

The active layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred binder layers comprise those with an electrically active layer which comprises an electrically inactive resin maerial, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

In still another embodiment, the combinations of transport layer and generator layer described above can be modified so as to have utility with the imaging process described in U.S. Pat. No. 3,041,167. This modification involves the following structural arrangement: (1) any suitable support, e.g. organic, inorganic; (2) on the support is deposited an injecting contact, e.g. carbon, selenium dioxide, gold, etc.; (3) in intimate electrical contact with the injecting contact is a transport layer, e.g. polycarbonate containing any one or more of the charge transport molecules disclosed herein; (4) the treated trigonal selenium containing charge generating layer in contact with the charge transport layer; and (5) an electrically insulating layer deposited on the charge generating layer. The electrically insulating layer can be an organic polymer or copolymers such as polyethylene, polycarbonate, polyacrylates, etc. The thickness of the polymer layer is not critical and can conveniently range from about 0.01 micrometer to about 200 micrometers. There must be a charge injecting contact between the substrate and the charge transport layer. If this requirement is satisfied, the particular material employed is not important.

A dielectric layer e.g. an organic polymer, may be deposited on the dispersed trigonal selenium layer. Many imaging methods can be employed with this type of photoconductor. Examples of these methods are described by P. Mark in Photographic Science and Engineering, Vol. 18, No. 3, pp. 254–261, May/June 1974.

The imaging methods require the injection of majority carriers or photoconductors possessing ambipolar properties. Also, such methods may require a system where bulk absorption of light occurs.

In all of the above charge transport layers, the activating compound which makes the electrically inactive polymeric material electrically active should be present in amounts of from about 15 to about 75 percent by weight.

The preferred electrically inactive resin materials are polycarbonate resins have a molecular weight from about 20,000 to about 100,000, more preferably from about 50,000 to about 100,000. The materals most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A.G. and a polycarbonate resin having a molecular weight of from about 20,000 to about 50,000 available as Merlon from Mobay Chemical Company.

Alternatively, as mentioned, the active layer may comprise a photogenerated electron transport material, for example, trinitrofluorenone, poly-N-vinyl carbazole/trinitrofluorenone in a 1:1 mole ratio, and the like.

The rested dark decay and the fatigued dark decay characteristics of a photoreceptor containing trigonal selenium without sodium selenite and sodium carbonate as the photoconductive materal dispersed in an electrically active binder as the generator layer which is overcoated with a transport layer are described by Horgan et al in U.S. Pat. No. 4,232,102, the disclosure thereof being incorporated herein by reference in its entirety. This member was made by the process as set forth in Example V of U.S. Pat. No. 4,232,102. The negative corona charge density was about $1.2\times10^{-3}$ C/m$^2$ and the thickness of the member was about 25 microns. The member was rested in the dark for 15 hours prior to charging. Then the member was charged to a maximum of 1280 volts initially measured 0.06 second after charging. After 0.22 second, while the photoreceptor remained in the dark, its rested dark decay was 60 volts, i.e. the surface potential had dropped to 1220 volts. After 0.66 second the surface potential was 1140 volts indicating a dark decay of 140 volts.

The fatigued dark decay was obtained by charging to 1280 volts as above, erasing the charge by exposing to light and then recharging. 1100 volts was measured 0.06 second after charging. This is 180 volts less than the member was capable of being charged initially in the rested dark decay test. After the member remained in the dark for 0.22 second, it discharged to 920 volts which represents a fatigued dark decay of 180 volts. After 0.66 second, the member discharged to 770 volts, indicating a fatigued dark decay of 330 volts.

It is convenient to express this fatigued dark decay as a percentage of the ratio of the surface potential change between 0.22 second and 0.66 second and the surface potential at 0.22 second after charging. In one sample, this amounted to 8% and 16% for the rested and fatigued dark decay, respectively.

The volts of charge on the surface of the member initially, i.e. after 15 hours dark rest, is almost the same as the volts of charge on the surface of the member after a xerographic cycle for the doped members. However, there is a measurable difference in these surface pootential values for trigonal selenium not containing selenite and carbonate. In other words, the drop between the rested and the fatigued dark decay is high in the unmodified and low in the trigonal selenium modified by the technique disclosed in U.S. Pat. No. 4,232,102.

In another sample described in U.S. Pat. No. 4,232,102, i.e. unmodified trigonal selenium, 180, 300 and 370 volts difference, respectively, were observed in the surface potential at 0.06, 0.22 and 0.66 second after charging of the rested, versus the fatigued member. However, the trigonal selenium samples of containing selenite and carbonate formed by the process disclosed in U.S. Pat. No. 4,232,102 showed almost no difference within experimental measurement error.

Thus it is shown that by modifying trigonal selenium with sodium selenite and sodium carbonate in accordance with the teachings of U.S. Pat. No. 4,232,102, the surface potential of a photoreceptor utilizing the modified trigonal selenium after fatigue is greater than the surface potential of an unmodified fatigued trigonal selenium containing photoreceptor. That is, the fatigued modified members of U.S. Pat. No. 4,232,102 accepted more charge, almost as much charge as these members accepted when rested, as compared to the fatigued unmodified member which accepted much less charge. The surface potential of the unmodified member became much less, must faster, than the surface potential of the modified members. Also the rested and the fatigued dark decay were more in the unmodified member after 0.06 second, 0.22 second and 0.66 second in the dark as compared to the rested and fatigued dark decay in the modified members.

Photo-induced discharge curves (PIDC) of members containing modified and unmodified trigonal selenium as the photoconductive material are also disclosed in U.S. Pat. No. 4,232,102. These PIDC curves show surface potential versus the exposure at the photoreceptor in Ergs/cm$^2$. The PIDC of each sample was taken at two different times, i.e. 0.06 second after exposing and 0.5 second after exposing. The exposure station was located 0.16 second after charging for a photoreceptor process speed of 30 inches per second. It is clear from the PIDC curves that photoreceptors containing unmodified trigonal selenium are unstable because they show a significant change with time. The PIDC curves of photoreceptors containing modified trigonal selenium are stable with time. That is, the PIDC curves vary only slightly with time between 0.06 second after exposing and 0.5 second after exposing. In fact, some PIDC curves of photoreceptors containing modified trigonal selenium show no variance since the PIDC for 0.06 second after exposing and the PIDC for 0.5 second after exposing were the same. Therefore, by using the techniques of U.S. Pat. No. 4,232,102 to modify the trigonal selenium contained in the photoreceptors, the dark decay was removed from the photoreceptors, or at least controlled, resulting in the stabilization of the PIDC curves of these modified members. If a machine were to use a photoreceptor in belt form and the photoreceptor being used contained unmodified trigonal selenium, poor image quality would result. After flash exposure and advancement to the development zone, the leading edge of the latent image on the belt would go into the development zone before the trailing edge of the image. The PIDC at the leading edge of the photoreceptor will be different from the PIDC at the trailing edge, since the PIDC of this unmodified member changes as a function of time. Therefore, the latent image when developed would be unacceptable. The PIDC would unacceptably vary from one end to the image to the other. However, this effect will vary as a function of the photoreceptor process speed, i.e. the greater the speed, the greater the effect. This would not happen when using a photoreceptor containing modified trigonal selenium as the photoconductive material as described in U.S. Pat. No. 4,232,102, since the PIDC curves of these members do not change as a function time. The latter situation leads to good print characteristics.

According to U.S. Pat. No. 4,232,102, all the sensitivities of the above described samples are a function of the sodium selenite and sodium carbonate weight percentage. In addition, the dark decay is also a function of the amount of these additives. Hence, depending on the additive level the PIDC curves are stable and do not change with time.

A preferred method of U.S. Pat. No. 4,232,102 for introducing the sodium selenite and sodium carbonate to the trigonal selenium involves washing the trigonal selenium with sodium hydroxide. The trigonal selenium, before the NaOH washing, contains less than 20 parts per million total sodium and less than 20 parts per million of other metal impurities. Typical levels of selenium dioxide and selenious acid are less than 250 parts per million. The NaOH washing of the trigonal selenium converts the selenium dioxide and selenious acid to sodium selenite and the hydroxide also reacts with the some of the trigonal selenium itself yielding sodium selenite and sodium carbonate. The amount of sodium selenite and sodium carbonate may be varied by varying the sodium hydroxide concentration. The excess sodium hydroxide is removed and depending on the amount of sodium selenite and carbonate left, this varies the electrical properties of the trigonal selenium. Preferred amounts of sodium selenite and carbonate in U.S. Pat. No. 4,232,102 range from a combined weight of 0.01 percent to 1.0 percent of approximately equal weight proportions, based on the total weight of trigonal selenium present.

A specific process described in U.S. Pat. No. 4,232,102 involves swirling washed trigonal selenium in a 0.6 normal (N) solution of sodium hydroxide for one-half hour and then allowing the solids to settle out and remain in contact with the sodium hydroxide solution for 18 hours. The supernatent liquid is decanted and retained and the treated trigonal selenium is filtered with filter paper. The retained supernatent liquid is used to rinse the beaker and funnel. The trigonal selenium is then dried at 60° C. in a forced air oven for 18 hours. It has been observed that even though one begins the swirl washing with the same concentration of sodium hydroxide solution, the sodium content in the filtered and dried doped trigonal selenium varies considerably from run to run and the fluctuation has been observed to vary as much as 52% from the lowest weight percent sodium content to the highest weight percent sodium content in a series of eleven consecutive runs. Since the filtered and dried doped trigonal selenium is normally stored for future processing, the dried doped trigonal selenium absorbs varying amounts of water which renders even less certain any attempt to predict the electrical and other properties of the final product.

In contrast, the process of the instant invention merely requires the addition of a known quantity of sodium in the form of sodium carbonate, sodium bicarbonate, sodium selenite, sodium hydroxide or mixtures thereof directly to a mixture of trigonal selenium particles, an organic resinous binder and a solvent for the binder in any desired sequence to form a milling mixture, milling the milling mixture to form a uniform dispersion, applying the dispersion to a substrate in an even layer, and drying the layer. The relative quantity of water in the milling mixture is significantly less than that employed in the specific process described in U.S. Pat. No. 4,232,102 and can even be omitted. Since all of the known quantity of sodium added to the milling mixture remains with the final product, the weight percent sodium content is totally predictable and does not vary from run to run and since the trigonal selenium may be stored in undoped form until it is milled with the binder and sodium compound, the content of water, if any, in the milling mixture is always known and totally controllable as is the electrical and other properties of the final product. The amount of sodium added to the milling mixture based on the total weight of trigonal selenium present in the milling mixture may be between about 2 parts per million to about 2.5 percent by weight sodium. In addition, the process of this invention may employ minimal amounts of sodium to control dark decay, e.g. 5 parts per million to about 1 percent by weight sodium based on the weight of the trigonal selenium is optimum. Minimization of the sodium content increases the adhesion of the charge generation layer to underlying metal substrates. At high relative humidities, layers containing sodium tend to cause pitting which is believed to be due to a reaction of the sodium with reactive underlying metal substrates such as aluminum. Reduction of sodium in the doped trigonal selenium minimizes this effect.

By adding the doping material directly to the milling mixture instead of utilizing the specific multi-step process described in U.S. Pat. No. 4,232,102 involving swirl washing, contact soaking, decanting, filtering, drying, and storing, the sodium content variations, the taking up and retention of moisture during storage, the many processing steps, the amount of sodium required, and the adhesion difficulties are minimized or totally eliminated.

The initial milling mixture should contain less than about 20 percent by weight water and, more desirably, contains less than about 10 percent water based on the total weight of the trigonal selenium because the presence of excess quantities of water adversely affects the rate of milling and electrical behavior of the final photoreceptor such as cycle up. Preferred results are achieved when the initial milling mixture contains less than about 5 percent by weight water. For example, in a 10,000 cycle test, both background voltage and residual voltage begins to increase noticeably during cycling with photoreceptor samples for which the water content in the milling mixture was increased above about 5 percent water based on the total weight of the trigonal selenium. Thus, if a concentrated aqueous sodium salt solution or concentrated aqueous sodium hydroxide solution is employed, the concentration of the aqueous solution should preferably be such that the total amount of water added to the mixture of trigonal selenium, polymer, and solvent for the polymer is less than 5 percent by weight based on the weight of the trigonal selenium in the initial milling mixture for preferred results. Less than about 5 percent by weight water based on the weight of the trigonal selenium in the initial milling mixture is considered optimum because best milling rates and electrical behavior stability of the final photoreceptor are achieved. Since the sodium additives (carbonate, bicarbonate, selenite and hydroxide) are all water soluble, the preparation of a concentrated aqueous solution of these additives may be effected by any suitable and conventional technique such as agitation with magnetic stirring bars, propellers, ultasonic mixers and the like. If desired, the sodium salts may be added to the milling mixture in anhydrous form and the presence of water entirely avoided.

The additive is combined with the trigonal selenium and any suitable binder such as those described above dissolved in a solvent for the binder in any desired sequence to form the milling mixture. Also, if desired, additional binder and/or solvent may be added to the milling mixture after completion of the milling to facilitate coating.

Satisfactory results may be achieved when the binder solution formulation contains from about 1 percent by weight to about 20 percent by weight polymer. Polymer solution concentrations higher than about 20 percent tend to become too viscous for efficient milling. A typical binder solution formulation consists of a solution of about 20 percent by weight polymer and about 80 percent by weight nonaqueous solvent. Sufficient binder is normally employed to disperse the trigonal selenium particles for milling. Additional binder may be added after milling but prior to coating to ensure that a coherent dried binder layer. Factors that should be considered in selecting the amount of solvent to be used for the milling mixture include coating drying time, viscosity of the binder, milling time and the like. Typical combinations of suitable binder and solvent combinations include poly-N-vinylcarbazole and tetrahydrofuran/toluene; poly-N-vinylcarbazole and methyl ethyl ketone/toluene; poly(hydroxyether) resin (PKHH, available from Union Carbide Corporation) and methyl ethyl acetone/methyl ethyl ketone; and the like. The binder solvent should be non-aqueous and inert with respect to the sodium additive. When the sodium additive is dissolved in water to form a concentrated solution for the milling mixture, it is generally preferred that at least one of the binder solvents is miscible with water for optimum results. By employing a non-aqueous binder solvent, anhydrous sodium dopant and dry undoped trigonal selenium in the milling mixture, the presence of water and attendant problems are totally avoided in both the milling mixture and final binder layer.

The milling mixture is milled by any suitable means until a uniform dispersion of trigonal selenium particles having an average particle size of between about 0.01 micrometer and about 5 micrometers is formed. Typical milling means include attritors, ball mills, sand mills, vibrating mills, jet micronizers and the like. Attritors are preferred because they are simple to operate, readily available and highly durable. The time desired for milling depends upon factors such as the efficiency of the milling means employed. Since only a minor change in dark decay characteristics occurs when the additive is added to the slurry after completion of milling but prior to application of the milling mixture to a substrate to form a binder layer, the additive is preferably added to the milling mixture prior to the midpoint of the milling process and, for optimum results, substantially immediately prior to initiation of milling. It is believed that sufficient freshly created surfaces on the trigonal selenium particles during milling must be brought into contact with the sodium during the milling process. Satisfactory results may be achieved with a starting size of between about 0.5 micrometers and about 10 micrometers. It is important, however, that the trigonal selenium particles be milled long enough to achieve an average particle size between about 0.01 micrometer and about 5 micrometers and a reduction in size of the trigonal selenium particles by a factor of between about 2 and about 50. Preferably, the milled particulate trigonal selenium should be in the size range from about 0.03 micrometer to 0.5 micrometer in diameter. The size range and size reduction factor are important in that the trigonal selenium will have a sufficiently high freshly created surface to volume ratio to achieve effective doping. This will control the surface component of dark decay. Excellent results are achieved with milling times of between about 16 and 24 hours with an attritor and an average starting trigonal selenium particle size between about 0.5 micrometer and about 5 micrometers.

The milled mixture may be applied to a substrate and dried by any suitable well known, conventional technique. Typical coating processes include spraying, bar coating, wire wound rod coating, dip coating and the like. Typical drying techniques include oven drying, radiant heat drying, forced air drying and the like.

The milling process of this invention provides a simpler, more precise technique to dope the milling mixture so as to control dark decay of binder layers formed from the milled mixtures. This is particularly surprising in view of the fact that the addition of sodium carbonate, sodium bicarbonate, sodium selenite or sodium hydroxide to trigonal selenium after milling fails to provide the significant improvement in charge acceptance and reduced dark decay achieved with the process of the instant invention.

DESCRIPTION OF PREFERRED EMBODIMENTS

The following examples further define, describe and compare exemplary methods of preparing the trigonal selenium of the present invention. Parts and percentages are by weight unless otherwise indicated. The examples, other than any control examples, are also intended to illustrate the various preferred embodiments of the present invention.

EXAMPLE I

A 127 micrometer thick aluminized Mylar substrate was rinsed with methlene chloride. The substrate was allowed to dry at ambient temperature. In a glove box with the humidity less than 20 percent and the temperature at 28° C., the substrate was coated with a layer of 0.5 percent DuPont 49,000 adhesive in chloroform and trichlorethane, 4 to 1 volume, with a Bird applicator to a wet thickness of about 12.7 micrometers. The resulting interface layer was allowed to dry in a glove box for about 1 minute and in an oven for about 10 minutes.

A milling mixture suspension was prepared by dissolving 288 grams of purified poly-N-vinylcarbazole in 2200 grams of a 50:50 by weight mixture of tetrahydrofuran and toluene and thereafter adding trigonal selenium having an initial average particle size of about 1 micrometer. The suspension was milled in a 1S Attritor (available from Union Process Co., Akron, Ohio) containing stainless steel balls having an average diameter of about 3 millimeters. This mixture was milled in the attritor for about 16–24 hours to form treated trigonal selenium particles having an average particle size of 0.05 micrometer. After milling, 578 grams of additional purified poly-N-vinylcarbazole dissolved in 6545 grams of a 50:50 by weight mixture of tetrahydrofuran and toluene were added to the milled mixture. The mixture was stirred to achieve uniformity and applied to the above interface layer with a Bird applicator to form a layer having a wet thickness of 26 microns. The coated member was annealed at 100° C. in a vacuum for 16 hours to form a layer having a dry thickness of 2 micrometers.

A charge transport layer was formed on this charge generator layer by applying a mixture of a 50:50 by weight solution of Makrolon, a polycarbonate resin having a molecular weight from about 50,000 to about 100,000 available from Farbenfabriken Bayer A.G., and N,N'-diphenyl-N,N'-bis(3-methylphenyl)-[1,1'-biphenyl]-4,4'-diamine dissolved in methylene chloride to give a 15 percent by weight solution. The components were coated on top of the generator layer with a Bird applicator and dried at temperature of about 80° C. in a vacuum for about 16 hours.

The generator layer of this photoreceptor contained no sodium additive and is thus is a control for the Examples that follow.

EXAMPLE II

The procedures and materials of Example I were repeated except that a 2 molar aqueous solution of sodium carbonate was added to the milling mixture suspension prior to milling. The 2 molar aqueous solution of sodium carbonate was prepared by disolving 10.6 grams of anhydrous sodium carbonate in water and bringing the total volume to 100 milliliters. 8.4 milliliters of the 2 molar aqueous solution of sodium carbonate was added to 398 grams of the milling mixture suspension described in Example I before milling to form a mixture having a sodium concentration of 0.1 weight percent based on the weight of the trigonal selenium.

EXAMPLE III

The procedures of Example II were repeated except that 16.9 milliliters of a 2 molar aqueous solution of sodium carbonate was added to 398 grams of the milling mixture suspension described in Example I before milling to form a mixture having a sodium concentration of 0.2 weight percent based on the weight of the trigonal selenium.

EXAMPLE IV

The procedures of Example I were repeated except that a 2 molar aqueous solution of sodium selenite was added to the milling mixture suspension prior to milling. The 2 molar aqueous solution of sodium selenite was prepared by disolving 28.4 grams of $Na_2SeO_3.H_2O$ in water and bringing the total volume to 100 milliliters. 8.4 milliliters of the 2 molar aqueous solution of sodium selenite was added to 398 grams of the milling mixture suspension described in Example I before milling to form a mixture having a sodium concentration of 0.1 weight percent based on the weight of the trigonal selenium.

EXAMPLE V

The procedures of Example IV were repeated except that 16.9 milliliters of a 2 molar aqueous solution of sodium selenite was added to 398 grams of the milling mixture suspension described in Example I before milling to form a mixture having a sodium concentration of 0.2 weight percent based on the weight of the trigonal selenium.

EXAMPLE VI

The photoreceptor described in Examples I through V were secured to an aluminum cylinder 30 inches in diameter. The drum was rotated at a constant speed of 60 revolutions per minute resulting in a surface speed of 30 inches per second. Charging devices, exposure lights, erase lights, and probes were mounted around the periphery of the cylinder. The locations of the charging devices, exposure lights, erase lights, and probes were adjusted to obtain the following time sequence:

| | |
|---|---|
| Charging | 0.0 second |
| Voltage Probe 1 ($V_1$) | 0.06 second |
| Expose | 0.16 second |
| Voltage Probe 2 ($V_2$) | 0.22 second |
| Voltage Probe 4 ($V_4$) | 0.66 second |
| Erase | 0.72 second |
| Voltage Probe 5 | 0.84 second |
| Start of Next Cycle | 1.00 second |

The photoreceptors were rested in the dark for 15 minutes prior to charging. They were then negatively corona charged in the dark and the voltage measured at Voltage Probe 1 ($V_1$). The device was discharged (erased) 720 microseconds after charging by exposure to about 500 erg/cm$^2$ of light. Probe readings were taken after 10 cycles. The values of the probe readings were as follows:

| PHOTORECEPTOR | $V_1$ | $V_2$ | $V_4$ | $\frac{V_1 \cdot V_4 \times 100}{V_1}$ |
|---|---|---|---|---|
| Example I (control) | 1030 | 940 | 815 | 21% |
| Example II (0.1% Na from $Na_2CO_3$) | 1020 | 960 | 890 | 13% |
| Example III (0.2% Na from $Na_2CO_3$) | 950 | 890 | 810 | 15% |
| Example IV (0.1 Na from $Na_2SeO_3$) | 810 | 760 | 720 | 11% |
| Example V (0.2% Na from $Na_2SeO_3$) | 810 | 760 | 710 | 12% |

Dark decay, the reduction of surface voltage with time in the dark may be expressed as a percentage of the initial voltage by the formula:

$$\frac{V_1 - V_4 \times 100}{V_1}$$

The employment of sodium salts in Examples II, III, IV, and V clearly demonstrate the reduction of dark decay compared to the control.

EXAMPLE VII

The procedures of Examples II and IV were repeated except that the concentrated solution of sodium carbonate was added to the slurry after milling but before application as a generator layer. The resulting photoreceptor exhibited only a minor change in dark decay characteristics compared to photoreceptors containing undoped trigonal selenium.

EXAMPLE VIII 100 grams of trigonal selenium is placed in a vessel and sufficient 0.6 normal (N) solution of sodium hydroxide is added to bring the volume to 4 liters. This mixture was swirl for one-half hour. The solids were allowed to settle out and remain in contact with the sodium hydroxide solution for 18 hours. The supernatent liquid was decanted and retained and the treated trigonal selenium was by filtering with No. 2 filter paper. The trigonal selenium was then dried at 60° C. in a forced air oven for 18 hours. This procedure was repeated 16 times to prepare 16 batches. The weight percent of sodium was determined for each batch. These batches were then used to prepare photoreceptors as described in Example I. The results of the sodium weight percent tests were as follows:

| Batch | Wt. % Na | Batch | Wt. % Na |
|---|---|---|---|
| 1 | 0.79 | 9 | 0.83 |
| 2 | 0.85 | 10 | 1.02 |
| 3 | 1.15 | 11 | 1.17 |
| 4 | 1.09 | 12 | 0.79 |
| 5 | 1.02 | 13 | 0.83 |
| 6 | 0.83 | 14 | 0.94 |
| 7 | 0.77 | 15 | 0.99 |
| 8 | 0.85 | 16 | 1.04 |

Although all the batches were treated, prepared into photoreceptors and tested in the same manner, the weight percent sodium based on the weight of trigonal selenium ranged from 0.77 percent to 1.17 percent. Thus, the batch with the highest concentration of sodium contained 52 percent more sodium than the lowest concentration of sodium. Since the doped trigonal selenium of the instant invention contains all of the sodium originally added to the milling mixture, the weight percent sodium based on the weight of trigonal selenium in the final doped trigonal selenium may be accurately predicted and controlled and there is no variation in sodium content compared to the doped trigonal selenium of this control Example.

EXAMPLE IX

The procedures of Example VIII were repeated 12 times to prepare 12 new batches. The weight percent of sodium was determined for each batch. These batches were then used to prepare photoreceptors as described in Example VII. The results of the sodium weight percent tests were as follows:

| Batch | Wt. % Na | Batch | Wt. % Na |
|---|---|---|---|
| 1 | 0.96 | 7 | 1.11 |
| 2 | 0.98 | 8 | 0.89 |
| 3 | 1.06 | 9 | 1.05 |
| 4 | 1.24 | 10 | 1.06 |
| 5 | 1.01 | 11 | 0.86 |
| 6 | 0.93 | 12 | 1.00 |

Although all the batches were treated, prepared into photoreceptors and tested in the same manner, the weight percent sodium based on the weight of trigonal selenium ranged from 0.86 percent to 1.24 percent. Thus, the batch with the highest concentration of sodium contained 44 percent more sodium than the lowest concentration of sodium. Since the doped trigonal selenium of the instant invention contains all of the sodium orignally added to the milling mixture, the weight percent sodium based on the weight of trigonal selenium in the final doped trigonal selenium may be accurately predicted and controlled and there is no variation in sodium content compared to the doped trigonal selenium of this control Example.

EXAMPLE X 100 grams of trigonal selenium was placed in a vessel and sufficient 1.0 normal (N) solution of sodium hydroxide is added to bring the volume to 4 liters. This mixture was swirled for one-half hour. The solids were allowed to settle out and remain in contact with the sodium hydroxide solution for 18 hours. The supernatant liquid was decanted and retained and the treated trigonal selenium was by filtering with No. 2 filter paper. The treated trigonal selenium was then dried at 60° C. in a forced air oven for 18 hours and then stored in ambient conditions. The treated trigonal selenium was thereafter divide into 4 lots and each lot processed in the following manner. Lot 1 was used "as is", that is wet from the moisture taken up from the ambient air. The water taken up from the ambient air by Lot 1 was determined to be about 19 Percent by weight water based on the weight of the trigonal selenium in the milling mixture. Lots 2, 3 and 4 were dried in vacuo to constant weight. Lot 3 was then combined with the milling mixture and 5 percent by weight water based on the weight of the trigonal selenium in the milling mixture. Lot 4 was combined with the milling mixture and 15 percent by weight water based on the weight of the trigonal selenium in the milling mixture. Each lot was milled in a rotating jar containing steel balls having an average diameter of about 3 millimeters, 2.4 grams of trigonal selenium, about 2.4 grams of purified poly-N-vinylcarbazole, and about about 38 grams of a 50:50 by weight mixture of tetrahydrofuran and toluene. After milling, 2.8 grams of additional purified poly-N-vinylcarbazole dissolved in 43.4 grams of a 50:50 by weight mixture of tetrahydrofuran and toluene were added to the milled mixture. The mixture was stirred to achieve uniformity and applied to the interface layer described in Example I with a Bird applicator to form a layer having a wet thickness of 40 microns. The coated member was annealed at 100° C. in a vacuum for 16 hours to form a layer having a dry thickness of 2 micrometers. The coated member was then coated with the charge transport layer as described in Example I and tested as described in Example VI. The background voltage, $V_{BG}$, was the voltage reading at Voltage Probe 4 after exposure and residual voltage, $V_R$, was the voltage reading after erase at Voltage Probe 5 (see description of Voltage Probes in Example VI). Exposure was at 5 ergs/cm$^2$ for photoreceptors prepared from the four lots at 16 cycles and 10,000 cycles were as follows:

| LOT | CYCLES | $V_{BG}$ | $V_R$ |
|---|---|---|---|
| 1 | 16 | 180 | 20 |
| | 10,000 | 330 | 100 |
| 2 | 16 | 370 | 50 |
| | 10,000 | 355 | 70 |
| 3 | 16 | 265 | 45 |
| | 10,000 | 255 | 60 |
| 4 | 16 | 175 | 20 |
| | 10,000 | 325 | 100 |

It can be seen that the effects of 19 percent water in Lot 1 and 15 percent water in Lot 4 significantly affect the cyclic stability of the background voltage and residual voltage compared to no water in Lot 2 and 5 percent water in Lot 3. More specifically, residual voltage increased by about 400 percent in Lots 1 and 4 compared to only about 40 percent in Lots 2 and 3.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for preparing an electrostatographic photosensitive device comprising combining a sodium additive selected from the group consisting of sodium carbonate, sodium bicarbonate, sodium selenite, sodium hydroxide and mixtures thereof with trigonal selenium particles substantially free of sodium, an organic resin binder and a solvent for said binder to form a milling mixture, milling said milling mixture to form a uniform dispersion, applying said dispersion to a substrate in an even layer having a sodium content identical to the sodium content of said milling mixture, and drying said layer.

2. A process for preparing an electrostatographic photosensitive device according to claim 1 including forming a concentrated aqueous solution of said sodium additive selected from the group consisting of sodium carbonate, sodium bicarbonate, sodium selenite, sodium hydroxide and mixtures thereof prior to combining said sodium additive with said trigonal selenium particles, said organic resin binder and said solvent for said binder.

3. A process for preparing an electrostatographic photosensitive device according to claim 2 wherein said milling mixture contains less than about 20 percent water based on the total weight of said trigonal selenium after combining said concentrated aqueous solution of said sodium additive with said trigonal selenium particles, said organic resin binder and said solvent for said binder.

4. A process for preparing an electrostatographic photosensitive device according to claim 2 wherein said milling mixture contains between about 2 parts per million and about 2.5 percent sodium based on the total weight of said trigonal selenium after combining said concentrated aqueous solution of said sodium additive with said trigonal selenium particles, said organic resin binder and said solvent for said binder.

5. A process for preparing an electrostatographic photosensitive device according to claim 4 wherein said milling mixture contains between about 5 parts per million and about 1 percent sodium based on the total weight of said trigonal selenium after combining said concentrated aqueous solution of said sodium additive with said trigonal selenium particles, said organic resin binder and said solvent for said binder.

6. A process for preparing an electrostatographic photosensitive device according to claim 1 including milling said milling mixture until said trigonal selenium particles have an average particle size of between about 0.01 micrometer and about 5 micrometers.

7. A process for preparing an electrostatographic photosensitive device according to claim 6 including milling said milling mixture until said trigonal selenium particles have an average particle size of between about 0.03 micrometer and about 0.5 micrometer.

8. A process for preparing an electrostatographic photosensitive device according to claim 1 including milling said milling mixture between about 16 hours and about 24 hours.

9. A process for preparing an electrostatographic photosensitive device according to claim 1 including milling said milling mixture until said trigonal selenium particles are reduced in size by a factor of between about 2 and about 50.

10. A process for preparing an electrostatographic photosensitive device according to claim 1 including adding additional organic resin binder to said dispersion prior to applying said dispersion to said substrate.

11. A process for preparing an electrostatographic photosensitive device according to claim 1 wherein said organic resin binder is poly-N-vinylcarbazole.

12. A process for preparing an electrostatographic photosensitive device according to claim 1 wherein said sodium salt is sodium carbonate.

13. A process for preparing an electrostatographic photosensitive device according to claim 1 wherein said sodium salt is sodium selenite.

14. A process for preparing an electrostatographic photosensitive device according to claim 1 including applying a charge transport coating to said layer after said drying of said layer.

15. A process for preparing an electrostatographic photosensitive device comprising combining a concentrated aqueous solution of a sodium additive selected from the group consisting of sodium carbonate, sodium bicarbonate, sodium selenite, sodium hydroxide and mixtures thereof with trigonal selenium particles substantially free of sodium, an organic resin binder and a solvent for said binder to form a milling mixture containing less than about 5 percent water based on the total weight of said trigonal selenium, milling said milling mixture to form a uniform dispersion, applying said dispersion to a substrate in an even layer having a sodium content identical to the sodium content of said milling mixture, and drying said layer.

16. A process for preparing an electrostatographic photosensitive device comprising combining a sodium additive in anhydrous form selected from the group consisting of sodium carbonate, sodium bicarbonate, sodium selenite and mixtures thereof with trigonal selenium particles substantially free of sodium, an organic resin binder and a solvent for said binder to form a milling mixture substantially free of water, milling said milling mixture to form a uniform dispersion, applying said dispersion to a substrate in an even layer having a sodium content identical to the sodium content of said milling mixture, and drying said layer.

* * * * *